US005894193A

United States Patent [19]

Amrine et al.

[11] Patent Number: 5,894,193

[45] Date of Patent: Apr. 13, 1999

[54] FIELD EMISSION DISPLAY WITH GETTER FRAME AND SPACER-FRAME ASSEMBLY

[75] Inventors: Craig Amrine; Clifford L. Anderson, both of Tempe; Ronald O. Petersen, Phoenix, all of Ariz.

[73] Assignee: Motorola Inc., Schaumburg, Ill.

[21] Appl. No.: 08/811,653

[22] Filed: Mar. 5, 1997

[51] Int. Cl.[6] ..... H01J 1/30; H01J 1/88; H01J 7/18

[52] U.S. Cl. ..... 313/495; 313/553; 313/559; 313/481

[58] Field of Search ..... 313/553, 558, 313/559, 495, 496, 497, 481, 309

[56] References Cited

U.S. PATENT DOCUMENTS

| | | | |
|---|---|---|---|
| 5,063,323 | 11/1991 | Longo et al. | 313/553 |
| 5,223,766 | 6/1993 | Nakayama et al. | 313/495 |
| 5,629,583 | 5/1997 | Jones et al. | 313/495 |
| 5,656,889 | 8/1997 | Niiyama et al. | 313/553 |
| 5,708,325 | 1/1998 | Anderson et al. | 313/495 |

*Primary Examiner*—Sandra L. O'Shea
*Assistant Examiner*—Michael Day
*Attorney, Agent, or Firm*—Jasper W. Dockrey; Kathleen A. Tobin

[57] ABSTRACT

A field emission display (400) includes a cathode plate (410), an anode plate (430), and a mechanical support/getter assembly (300) being disposed between the cathode plate (410) and the anode plate (430). The mechanical support/getter assembly (300) includes a unitary spacer-frame assembly (310) made from a photosensitive glass. A method for fabricating the mechanical support/getter assembly (300) includes the steps of: selectively exposing inter-spacer regions (110) and a getter frame region (120) of a layer (100) of the photosensitive glass to UV radiation, heating the layer (100) to crystallize the UV-exposed regions, and removing the crystallized inter-spacer regions (110) and partially removing the crystallized getter frame regions by contacting the layer (100) with an acid, thereby forming spacer ribs (314) and a getter land (322). The method further includes providing a getter frame (320) on the spacer land (322).

7 Claims, 3 Drawing Sheets

FIELD EMISSION DISPLAY WITH GETTER FRAME AND SPACER-FRAME ASSEMBLY

FIELD OF THE INVENTION

The present invention pertains to the area of field emission displays and, more particularly, to spacer structures for field emission displays.

BACKGROUND OF THE INVENTION

Spacers for field emission displays are known in the art. Prior art spacers include structural elements which must be individually placed and aligned. Individual placement of these elements adds complexity and time to the fabrication of field emission displays.

Prior art spacers also require affixation to the display plates in the active region of the display. The active region of the display includes the electron emitting elements, which may include Spindt tips, and the light-emitting phosphor elements. A disadvantage of using affixants in the active region is a high risk of damage to these active elements during the affixing process.

Field emission displays require spacers having a high aspect ratio. The aspect ratio is the ratio of the height of the spacer relative to the width. In order to make the spacer invisible to the viewer, the spacer needs to have a thickness that will fit within the region available between adjacent pixels. This distance is equal to about 100 micrometers, which is about one-tenth of the distance between the display plates.

Prior art field emission displays further include gettering materials for the removal of contaminant gases. The configurations of prior art getters for field emission displays add unnecessary weight and volume to the device. In one prior art scheme, the gettering material is housed in a vacuum chamber, behind the cathode plate. The vacuum chamber is defined by an additional backplate, which adds unnecessary weight and volume to the display.

Accordingly, there exists a need for an improved spacer structure for a field emission display which does not require affixation within the active region of the display, which is simple to handle and align, and which provides high aspect ratio spacers. There further exists a need for an improved getter configuration which reduces the weight and volume of the display.

Figure 1:
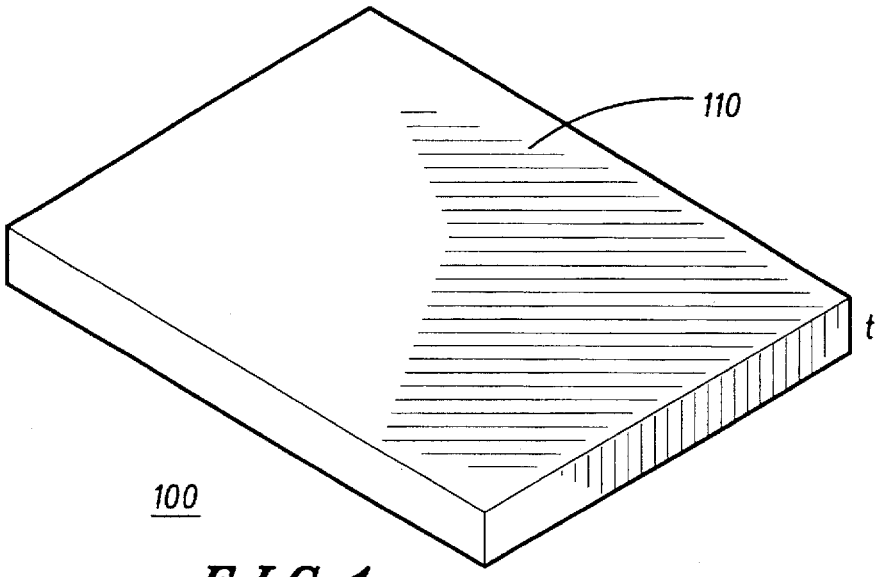
FIG. 1 is a perspective view of a layer of photosensitive glass used in a method for fabricating a field emission display in accordance with the present invention.

It will be appreciated that for simplicity and clarity of illustration, elements shown in the Figures have not necessarily been drawn to scale. For example, the dimensions of some of the elements are exaggerated relative to each other. Further, where considered appropriate, reference numerals have been repeated among the Figures to indicate corresponding elements.

DESCRIPTION OF THE PREFERRED EMBODIMENTS

The invention is for a field emission display having a mechanical support/getter assembly, and for a method for fabricating the field emission display. The invention simplifies the fabrication of field emission displays. The method of the invention reduces the risk of harm to active elements of the display during the incorporation of spacer structures. It also provides ease of alignment of spacers. A field emission display in accordance with the invention has a gettering configuration that reduces the weight and volume of the display.

FIG. 1 illustrates a perspective view of a layer 100 of a photosensitive glass used in a method for fabricating a field emission display in accordance with the invention. Layer 100 has a thickness t. In the embodiment of FIG. 1, the thickness t is about 1 millimeter. In general, this photosensitive glass includes a glass that is crystallizable using a process that includes exposure to UV radiation, which is followed by a heat treatment. The heat treatment results in the crystallization of the photosensitive glass. The crystallized material is etchable upon exposure to an acid.

In the preferred embodiment, the photosensitive glass has the following composition: about 75 weight % $SiO_2$, about 7 weight % $LiO_2$, about 3 weight % $K_2O$, about 3 weight % $Al_2O_3$, about 0.1 weight % $Ag_2O$, and about 0.02 weight % $CeO_2$. This material may be obtained from Hoya Optical Division of Tokyo, Japan, which makes a photosensitive glass from their PEG3 glass. It may also be obtained from Schott Glaswerke of Mainz, Germany, which makes a photosensitive glass from their "FOTURAN" glass.

Figure 2:
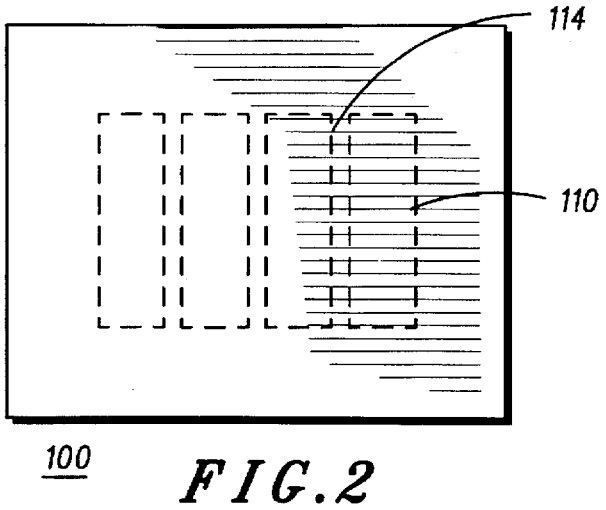
FIGS. 2 and 3 are top plan views of the layer of photo sensitive glass of FIG. 1.

FIG. 2 illustrates a top plan view of layer 100. Indicated in FIG. 2 by dashed-line boxes are a plurality of inter-spacer regions 110, which include generally rectangular regions of layer 100. In accordance with the method of the invention, inter-spacer regions 110 are removed. In the preferred embodiment, this removal is achieved by, first, selectively exposing inter-spacer regions 110 to ultraviolet radiation having a wavelength within the range of 280–320 nanometers. In the preferred embodiment, UV radiation at 320 nm is used. This UV exposure step is performed at room temperature.

Subsequent to the UV exposure, layer 100 is heated to a temperature of about 580° C. This heat treatment effects the crystallization of inter-spacer regions 110. The duration of this heat treatment depends upon the degree of crystallization desired. A higher degree of crystallization results in greater ease of etching with acid. By controlling the degree of crystallization, the etch rate during the subsequent acid treatment may be controlled. Inter-spacer regions 110 are removed completely, so that a high degree of crystallization therein is desired. This is achieved by performing the heating step for about one hour.

Following the selective crystallization of inter-spacer regions 110, the crystallized inter-spacer regions are removed by rinsing layer 100 with an acid solution. For the embodiment of FIG. 2, the acid solution includes an aqueous solution of hydrogen chloride, having 5–6 molar % hydrogen chloride. The acid solution is contacted equally with the opposing outer surfaces of the crystallized inter-spacer regions so that tapering along the depth of layer 100 is reduced.

Adjacent ones of inter-spacer regions 110 are spaced apart by about 100 micrometers. A spacer region 114 is disposed between adjacent inter-spacer regions 110. Spacer regions 114 are not UV-exposed and, therefore, do not crystallize during the heating of layer 100. Thus, during the acid rinse, spacer regions 114 remain intact and glassy.

Figure 3:
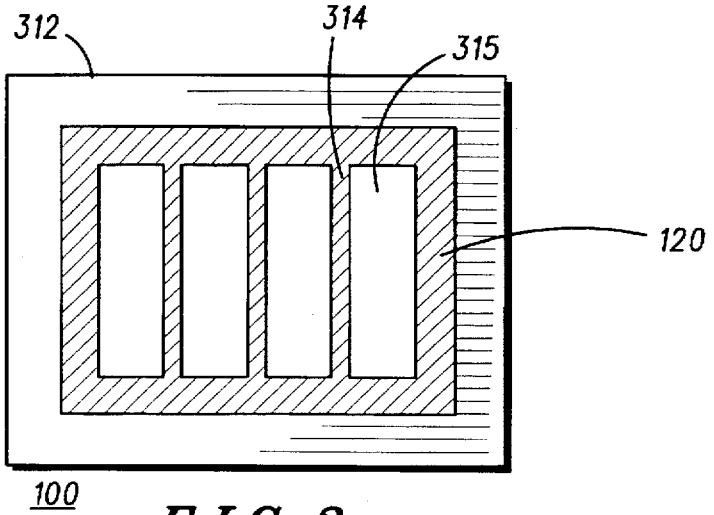

FIG. 3 illustrates a top plan view of layer 100 subsequent to the acid rinse step. The removal of inter-spacer regions 110 results in the formation of apertures 315 and a plurality of spacer ribs 314. Spacer ribs 314 are coextensive with a frame 312, which includes the portion of layer 100 that surrounds spacer ribs 314. In the embodiment of FIG. 3, each of spacer ribs 314 has a width of about 100 micrometers and a height of about 1 millimeter. These dimensions, as well as the length of spacer ribs 314, are predetermined to be compatible with the configuration of the field emission display. Further depicted in FIG. 3, by a dashed-line box and cross-hatching, is a getter frame region 120.

Following the formation of spacer ribs 314, the thickness of layer 100 is reduced at getter frame region 120 to form a getter land, which is described in greater detail with reference to FIG. 4. In one embodiment, the thickness of layer 100 is reduced at getter frame region 120 by etching getter frame region 120 in a manner similar to that described with respect to the removal of inter-spacer regions 110. Getter frame region 120 is selectively crystallized in a manner similar to that described with reference to FIG. 2. However, the extent of crystallization of getter frame region 120 is less than that of inter-spacer regions 110. This is achieved by one or both of the following modifications of the crystallization steps. First, the duration of the UV exposure can be reduced. Second, the duration and/or temperature of the heating step can be reduced.

After the selective crystallization of getter frame region 120, an acid etch similar to that described with reference to FIG. 2 is performed. The acid etch is controlled so that getter frame region 120 is partially removed to a predetermined depth that is less than the thickness of layer 100. In the embodiment of FIG. 3, the acid etch is performed at one of the opposed major surfaces of layer 100. The resulting structure comprises a unitary spacer-frame assembly, which is described in greater detail with respect to FIGS. 4 and 5.

In another embodiment of the invention, the step of reducing the thickness of layer 100 at getter frame region 120 includes performing a selective mechanical etch of getter frame region 120. The selective mechanical etch can be achieved by employing a precision sand blasting technique.

This mechanical etch of getter frame region 120 is performed prior to the removal of inter-spacer regions 110.

Figure 4:
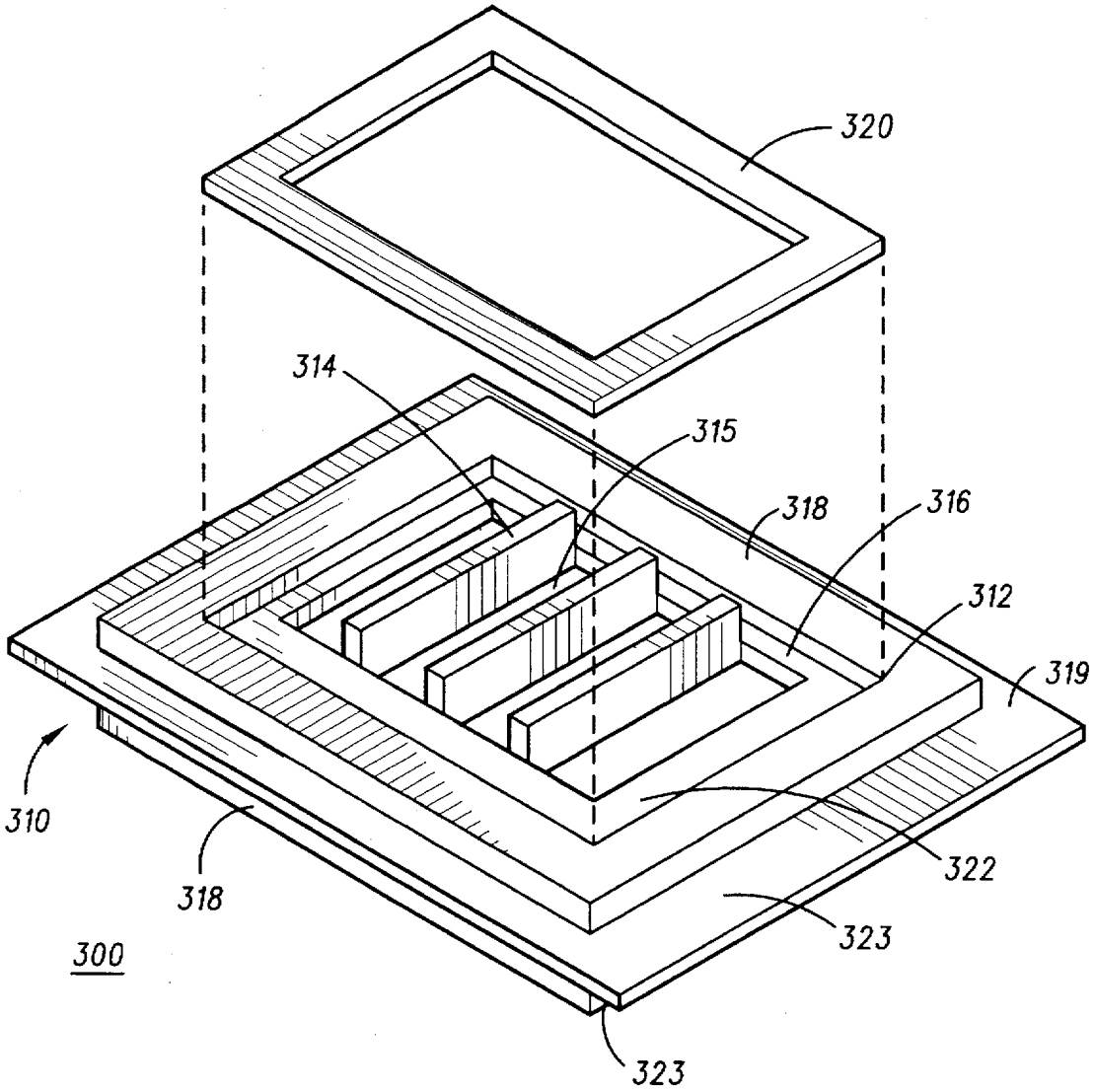
FIG. 4 is an exploded perspective view of a mechanical support/getter assembly in accordance with the present invention.

FIG. 4 illustrates an exploded, perspective view of a mechanical support/getter assembly 300, in accordance with the invention. Mechanical support/getter assembly 300 includes a unitary spacer-frame assembly 310 and a getter frame 320. Unitary spacer-frame assembly 310 is made in the manner described with reference to FIGS. 1–3. The partial removal of getter frame region 120 of FIG. 3 forms a first peripheral portion 316 of frame 312. First peripheral portion 316 defines a getter land 322, as indicated in FIG. 4. Getter land 322 includes a surface upon which getter frame 320 is disposed. The region of frame 312 that is not etched includes a second peripheral portion 318, as indicated in FIG. 4.

Getter frame 320 is made from a gettering material, preferably powdered $ZrO_2$, which is bonded to a substrate. The substrate may be made from nickel and has a thickness of about 50 micrometers. The scope of the invention is not limited to the particular gettering material of the preferred embodiment.

In the embodiment of FIG. 4, an outer peripheral portion 319 of frame 312 is partially etched to a predetermined depth, in a manner similar to that described with reference to the formation of getter land 322. The partial etch of outer peripheral portion 319 is performed at both of the opposed major surfaces of layer 100, so that a pair frit lands 323 are formed in outer peripheral portion 319.

Figure 5:
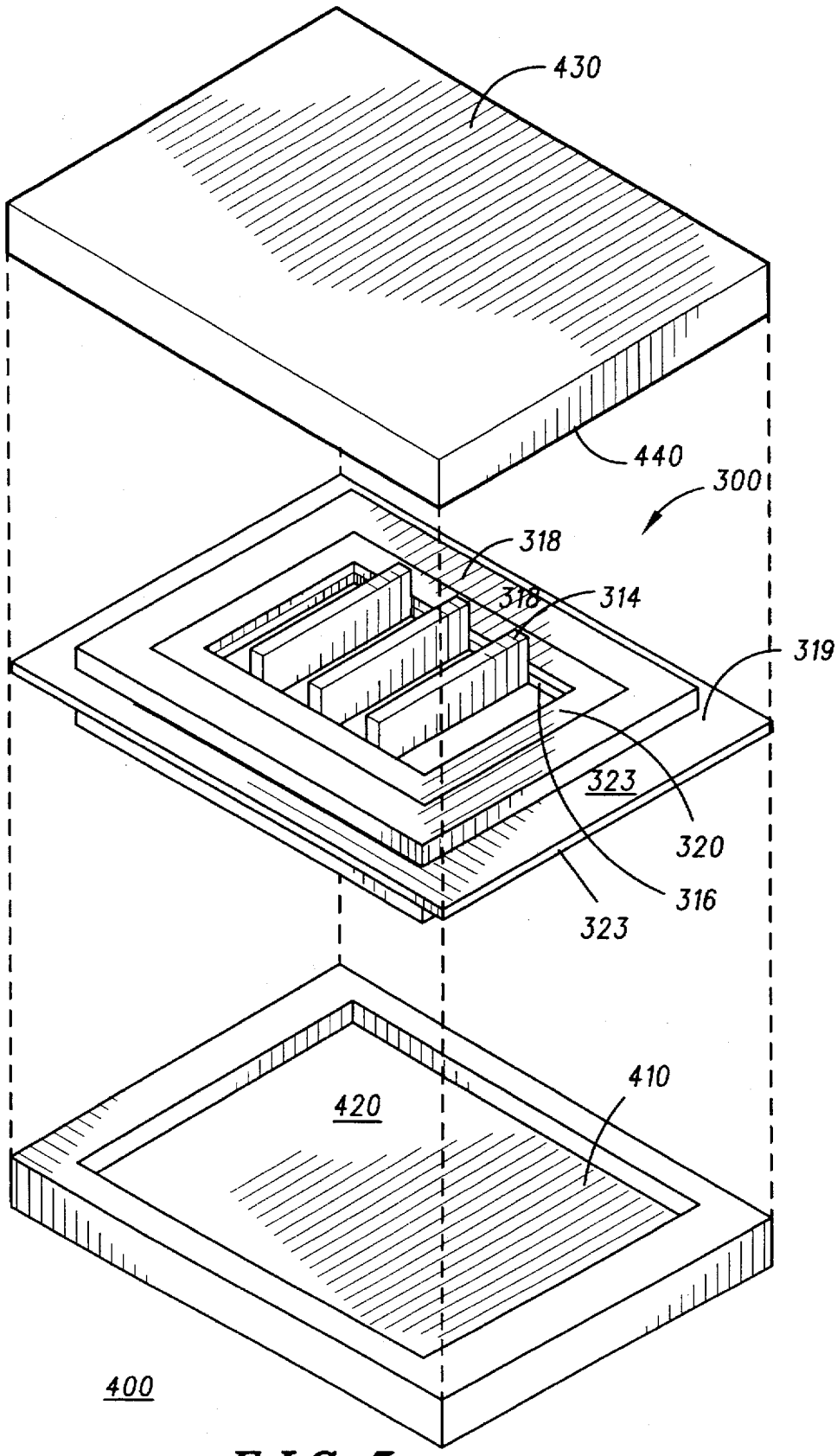
FIG. 5 is an exploded perspective view of a field emission display including the mechanical support/getter assembly of FIG. 4 in accordance with the present invention.

FIG. 5 illustrates an exploded perspective view of a field emission display 400, in accordance with the invention. Field emission display 400 includes mechanical support/getter assembly 300 of FIG. 4. Field emission display 400 further includes a cathode plate 410 and an anode plate 430. Mechanical support/getter assembly 300 is disposed between an active major surface 420 of cathode plate 410 and an active major surface 440 of anode plate 430.

Active major surface 420 of cathode plate 410 includes electron emitting elements, such as Spindt tips, edge emitters, surface emitters, and the like. Active major surface 440 of anode plate 430 includes the electron-receiving elements, which are aligned with the electron emitting elements of cathode plate 410. These electron-receiving elements include deposits of cathodoluminescent material.

Mechanical support/getter assembly 300 is affixed to cathode plate 410 and anode plate 430 by applying a frit sealant (not shown) to frit lands 323 and affixing cathode and anode plates 410, 430 thereto, as shown in FIG. 5. The application of the frit sealant to frit lands 323 reduces the display width that is attributable to the frit sealant.

The frit sealing process is performed in a vacuum oven. Sealing in a vacuum oven simultaneously establishes vacuum conditions in the compartments of field emission display 400. These compartments are defined by spacer ribs 314, active major surfaces 420, 440, frame 312, and getter frame 320. By performing the frit sealing step in a vacuum oven, evacuation of these compartments is not required subsequent to the frit sealing step.

In another embodiment of the present invention, the sum of the height of getter frame 320 and the height of first peripheral portion 316 is less than the height of second peripheral portion 318. This configuration defines gaps that allow fluid continuity between the compartments of the display. These gaps allow gases to flow around spacer ribs 314, so that the display compartments may be evacuated subsequent to the sealing step. Each of these gaps is defined by one of spacer ribs 314, second peripheral portion 318, active major surface 440, and getter frame 320.

Spacer ribs 314 provide standoff support between cathode plate 410 and anode plate 430 subsequent to the formation of the vacuum therebetween. Getter frame 320 removes contaminant gaseous species generated during the frit sealing process and during the operation of field emission display 400. Getter frame 320 is exposed to each of the compartments defined by spacer ribs 314. This ensures gettering action throughout field emission display 400.

In summary, a field emission display in accordance with the invention provides spacers which are simple to fabricate, handle, align, and affix. The present invention further provides a getter configuration and a frit sealing configuration which reduce the weight and volume of a field emission display.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

We claim:

1. A field emission display comprising:

a cathode plate having an active major surface;

an anode plate having an active major surface opposing the active major surface of the cathode plate;

a photo-sensitive glass, unitary spacer-frame assembly disposed between the cathode plate and the anode plate; and a getter frame disposed on the unitary spacer-frame assembly.

2. The field emission display of claim 1, wherein the photo-sensitive glass comprises about 75 weight % $SiO_2$, about 7 weight % $LiO_2$, about 3 weight % $K_2O$, about 3 weight % $Al_2O_3$, about 0.1 weight % $Ag_2O$, and about 0.02 weight % $CeO_2$.

3. The field emission display of claim 1, wherein the photo-sensitive glass, unitary spacer-frame assembly comprises a frame and a spacer rib having first and second opposed ends, the spacer rib being coextensive with the frame at each of the first and second opposed ends.

4. The field emission display of claim 3, wherein the frame comprises a first peripheral portion having a first height and a second peripheral portion having a second height, the first peripheral portion being coextensive with the second peripheral portion, the first height being less than the second height.

5. The field emission display of claim 4, wherein the first peripheral portion has a getter land, and wherein the getter frame is disposed on the getter land of the first peripheral portion.

6. The field emission display of claim 5, wherein the getter frame has a height, and wherein the sum of the height of the getter frame and the first height of the first peripheral portion is less than the second height of the second peripheral portion.

7. The field emission display of claim 4, wherein the frame of the unitary spacer-frame assembly further comprises a third outer peripheral portion circumscribing and being coextensive with the second peripheral portion and having a third height, the third height being less than the second height, the third outer peripheral portion defining a frit land.

* * * * *